US005613264A

United States Patent [19]

Knowles

[11] Patent Number: 5,613,264

[45] Date of Patent: Mar. 25, 1997

[54] PAINT ROLLER CORNER COVER

[76] Inventor: Curtis N. Knowles, 6 Winterberry Dr., Wilbraham, Mass. 01095

[21] Appl. No.: 102,047

[22] Filed: Aug. 4, 1993

[51] Int. Cl.[6] ..... B44D 3/28

[52] U.S. Cl. ..... 15/230.11; 15/246

[58] Field of Search ..... 15/230.11, 246

[56] References Cited

U.S. PATENT DOCUMENTS

| | | | |
|---|---|---|---|
| 2,927,709 | 3/1960 | Hoffman et al. . | |
| 2,959,800 | 11/1960 | Bischoff | 15/230.11 |
| 2,972,158 | 2/1961 | Voskresenski | 15/230.11 |
| 3,662,422 | 5/1972 | Christensen et al. | 15/230.11 |
| 3,886,621 | 6/1975 | Welsh | 15/230.11 |
| 3,965,521 | 6/1976 | Wardell | 15/230.11 |
| 4,008,820 | 2/1977 | Ruetz | 215/355 |
| 4,402,102 | 9/1983 | Al-samman | 15/230.11 |
| 4,504,009 | 3/1985 | Boik et al. | 215/355 |

*Primary Examiner*—David Scherbel
*Assistant Examiner*—Randall E. Chin

[57] ABSTRACT

The invention is a paint roller corner cover consisting of a cap made out of any suitable material having a circumference equivalent to that of a paint roller cover and having a narrow circular annular base with a holding mechanism consisting of lugs which are evenly spaced around the outside of the end cover cap to serve as a holding mechanism. The outside surface of the end cap is matted with a napped material Which is to be similar or identical to the nap material on the paint roller. This device provides a paint roller corner cover which effectively paints a 90 degree corner and which results in a smooth final surface area. In addition, the invention provides an end cap which can easily be attached and detached, the holding mechanism of which does not interfere with the circumference of the paint roller. In addition, the invention is simple and inexpensive to manufacture, assemble and use.

1 Claim, 3 Drawing Sheets

FIG 1
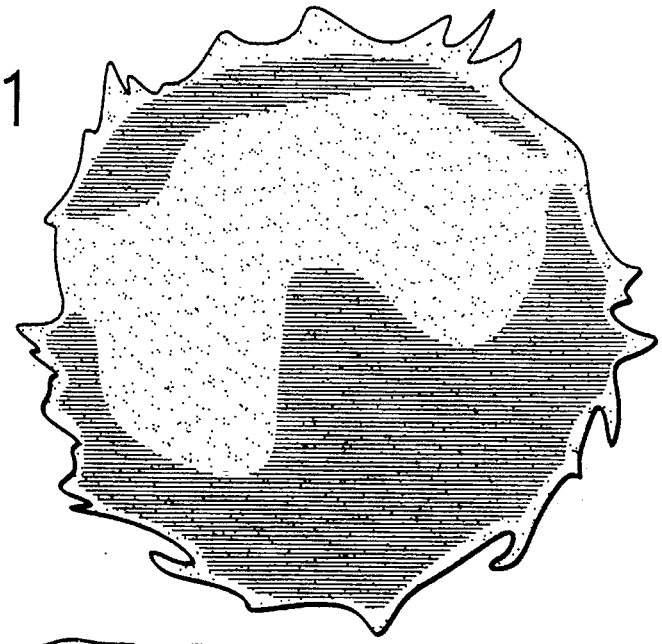
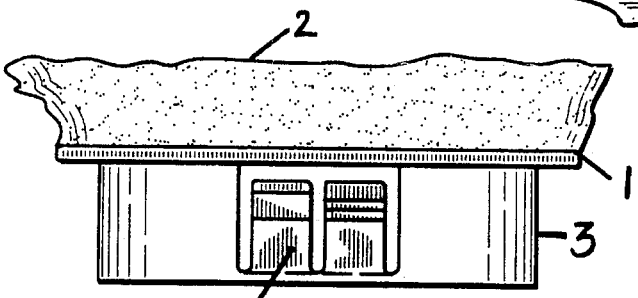
FIG 2
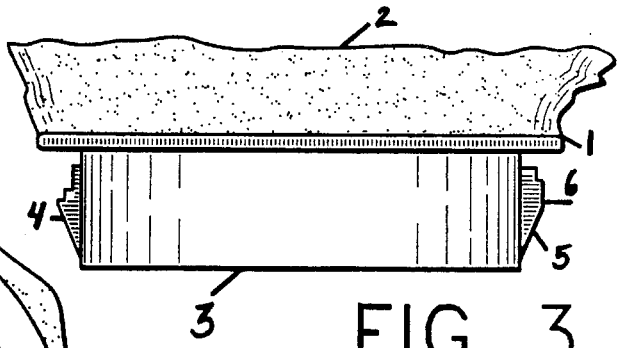
FIG 3
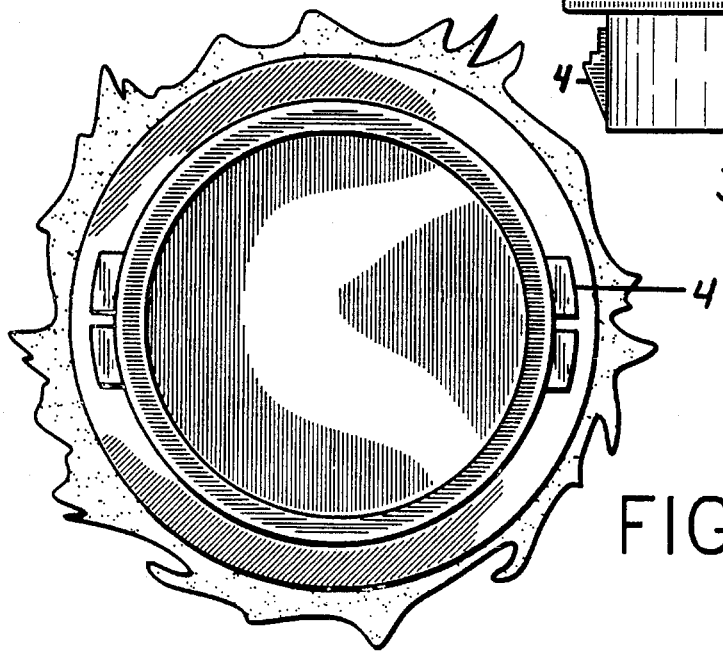
FIG 4

PAINT ROLLER CORNER COVER

BACKGROUND OF THE INVENTION

1. Field of the Invention

This invention relates to paint rollers and covers for paint rollers.

2. Invention Disclosure Statement

As shown in the drawings, the invention is a cap made out of any suitable material having a dimension equivalent to that of the paint roller cover and having a narrow, circular base with a holding mechanism which is inserted into the paint roller. The circular outside end of the cover cap is matted with a nap material which is similar or identical to the nap material on the paint roller, such that the painter is able to paint a corner where two walls meet and accomplish painting of the opposing corner.

BRIEF SUMMARY OF THE INVENTION

The aim of the invention is to eliminate the need for the painter to use a brush in the corner. It also eliminates the different textured finish that is left in a corner painted by a brush. The invention thus saves times, money and supplies for the painter. The invention may decrease the use of chemicals which are hazardous to the environment such as paint removers. In the end analysis, therefore, there is a financial incentive to the invention.

BRIEF DESCRIPTION OF THE DRAWINGS

FIG. 1: A perspective view of the nap side of the Paint Roller Corner Cover

FIG. 2: A side view of the Paint Roller Corner Cover showing the configuration of the opposing lock mechanisms FIG. 3: A side view of the Paint Roller Corner Cover showing the configuration of the opposing holding mechanisms FIG. 4: A bottom (or under) view of the Paint Roller Corner Cover showing the holding mechanism as it relates to the napped surface

DETAILED DESCRIPTION OF TEE PREFERRED EMBODIMENT

The preferred embodiment of the invention consists of an end cap as shown in FIG. 3. The end cap has a circular disc (1), one side of which has a nap or matted material (2) and the other side of the disc has a protuberance in the form of an annular base (3).

The outer surface of the base (3) can be smooth and dimensional such that it will provide a friction fit with the inner surface of a paint roller cover when it is inserted into the end of the paint roller cover.

Figure 5:
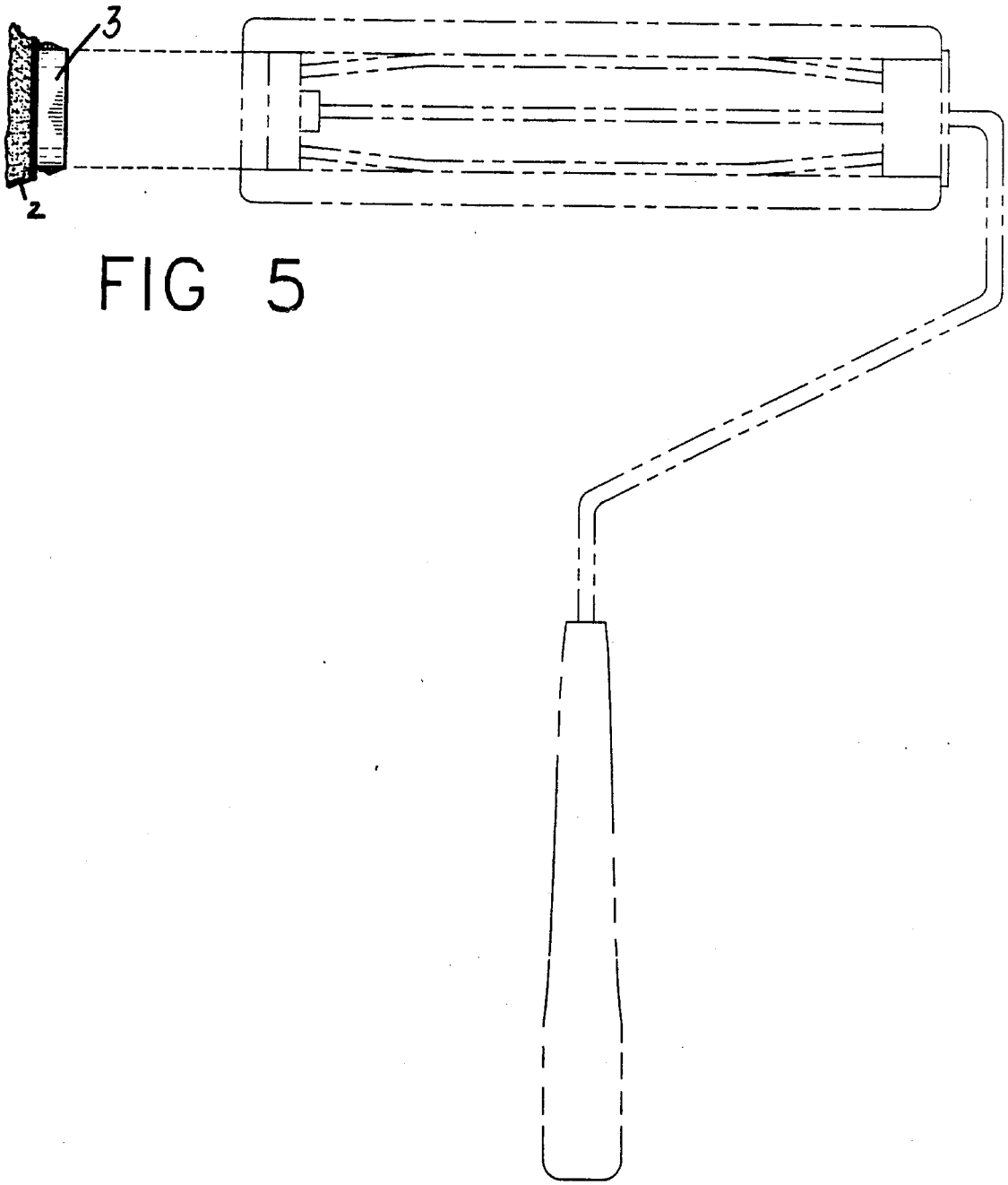
FIG. 5: A view of the Paint Roller Corner Cover as it would be installed on a paint roller which has been installed onto a paint roller handle
Figure 6:
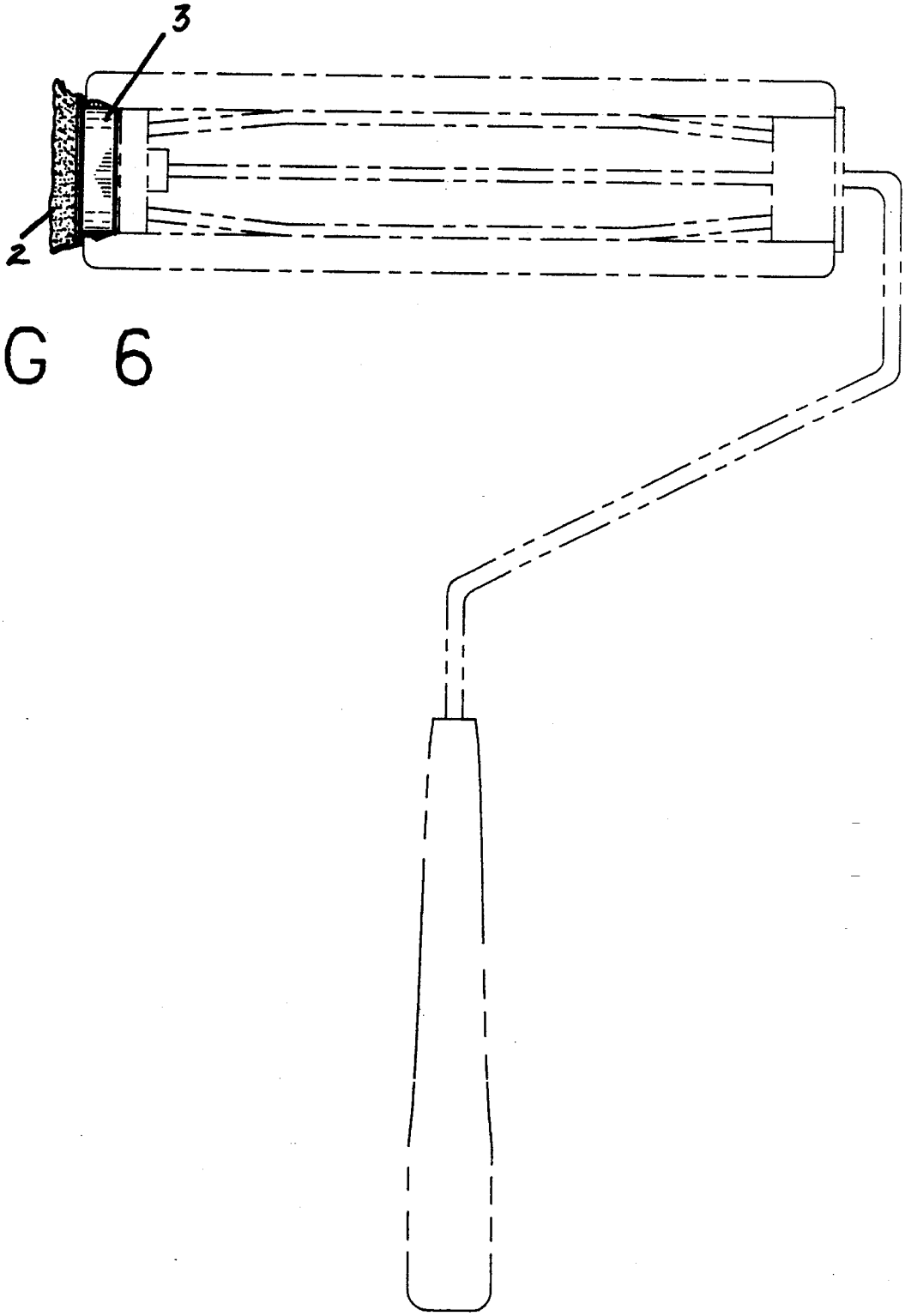
FIG. 6: A view of the Paint Roller Corner Cover after being installed onto the paint roller which has been installed onto the paint roller handle

In a preferred embodiment of the invention, the outer surface of the base (3) may be provided with holding means. The holding means may be a plurality of lugs (4) circumferentially spaced about the periphery of the base (3). The holding means (4) have outer circumferential surfaces (6), the diameter of which is slightly greater than the inner diameter of the roller cover in order to provide a friction fit when inserted into the end of the roller cover. The lugs (4) may also have an inclined surface (5). The lugs (4) and preferably molded of plastic and integral with the base. As shown in FIG. 5 and 6, the protuberance means (3) extends axially from the circular disc (1) into the roller cover at the free end of the roller a length equal to a length defined as, the length the roller cover extends axially beyond the free end of the roller to hold the circular disc (1) in place on the paint roller assembly by frictionally engaging the inner surface of the roller cover only a the inner surface which is located axially beyond the free end of the roller.

The lugs (4) are spaced circumferentially around the end cap. The end cap may be used with a standard 9 inch roller handle as commercially available in the U.S. and a standard 9½ inch length roller cover which is commercially available in Canada. The difference in lengths of the roller cover and handle results in a space at the end of the roller cover into which my corner cover may be inserted. Alternatively, my corner cover may be used with a 9 inch roller cover and a 7 inch roller handle, both standard length available in the U.S. and readily commercially available. The paint roller handle per se forms no part of my invention. My end cap invention works well with various other commercially available, well known roller handles.

A second embodiment consists of a standard 9 inch roller cover as manufactured in the United States into one end of which the Paint Roller Corner Cover is inserted and a 9 inch roller handle as manufactured in the United States is inserted into the other end. Since the 9 inch roller and end cap are longer than the 9 inch cover when they are flush with the roller cover at one end, the roller will protrude from the cover at the other end. A sleeve or "O ring" may be provided at the other end to prevent paint from seeping into the roller cover at this end.

I claim:

1. A conventional paint roller assembly having a handle, a roller having two ends, said handle being rotatably mounted at one of said ends of said roller, a cylindrical roller cover having an inner surface and an outer surface, with the inner surface mounted concentrically on said roller such that the roller cover extends axially beyond said other of said ends of the roller, and a corner cover end cap to enable the simultaneous application of paint to corner surfaces perpendicular to the surface being painted by the roller circumference, said corner cover end cap comprising a disc having two sides, a napped material on one of said sides of said disc and a protuberance means on the other of said sides of said disc, said protuberance means extending axially from said disc a length equal to the length said roller cover extends axially beyond said other of said ends of said roller and said protuberance means being adapted to be inserted into the roller cover at the other of said ends of the roller to hold said corner cover end cap in place on the paint roller assembly by frictionally engaging the inner surface of said roller cover at the inner surface which is located axially beyond the other of said ends of the roller.

* * * * *